United States Patent [19]

McNamara

[11] Patent Number: 4,968,212

[45] Date of Patent: Nov. 6, 1990

[54] APPARATUS FOR GRIPPING AND LIFTING OBJECTS POSITIONED IN ROWS

[75] Inventor: John O. McNamara, Savannah, Ga.

[73] Assignee: Peeples Industries, Inc., Savannah, Ga.

[21] Appl. No.: 316,211

[22] Filed: Feb. 27, 1989

[51] Int. Cl.[5] ..... B65D 85/62; B66C 1/42

[52] U.S. Cl. ..... 414/618; 414/911; 294/81.62; 294/87.1; 294/119.1

[58] Field of Search ..... 294/63.1, 81.62, 87.1, 294/119.1; 414/618, 626, 225, 908, 910, 911

[56] References Cited

U.S. PATENT DOCUMENTS

| | | | |
|---|---|---|---|
| 1,710,096 | 4/1929 | Luce | 414/618 |
| 2,138,498 | 11/1938 | McMillan | 294/81.62 X |
| 2,528,783 | 11/1950 | Reinhart et al. | 294/87.1 X |
| 2,548,063 | 4/1951 | Reinhart | 294/87.1 X |
| 2,548,064 | 4/1951 | Reinhart | 414/623 |
| 2,614,711 | 10/1952 | Hauser | 414/622 |
| 2,668,731 | 2/1954 | Neher | 294/63.1 |
| 2,706,658 | 4/1955 | Jewell | 414/626 X |
| 2,924,484 | 2/1960 | Tolsma | 294/87.1 |
| 2,959,445 | 11/1960 | Breslav | 414/626 X |
| 3,212,808 | 10/1965 | Breslav et al. | 294/81.62 |
| 3,262,595 | 7/1966 | Seip, Jr. et al. | 294/87.1 X |
| 3,302,967 | 2/1967 | Harris et al. | 294/87.1 X |
| 3,411,636 | 11/1968 | Wallis | 414/225 X |
| 3,825,293 | 7/1974 | Schwarz | 294/63.1 |

FOREIGN PATENT DOCUMENTS

| | | | |
|---|---|---|---|
| 931579 | 7/1955 | Fed. Rep. of Germany | 414/919 |
| 2166234 | 6/1973 | Fed. Rep. of Germany | 294/63.1 |
| 3042174 | 6/1982 | Fed. Rep. of Germany | 294/87.1 |
| 1209512 | 3/1960 | France | 414/626 |
| 1355294 | 2/1964 | France | 294/63.1 |
| 0120805 | 12/1970 | Norway | 294/87.1 |
| 0889556 | 12/1981 | U.S.S.R. | 294/87.1 |

*Primary Examiner*—David A. Bucci
*Assistant Examiner*—Robert S. Katz
*Attorney, Agent, or Firm*—Pennie & Edmonds

[57] ABSTRACT

An apparatus for gripping and lifting closely packaged objects formed in rows and adjacent one another having a main horizontal beam, end gripper units adjustable through power means and self-positioning cross gripper units intermediate the end grippers. The grippers having elongated fingers which depend from the gripper units are powered toward the object to grip it and powered away from the object to release it. The objects are shaped and positioned to form spaces therebetween even when tangent to one another.

3 Claims, 5 Drawing Sheets

APPARATUS FOR GRIPPING AND LIFTING OBJECTS POSITIONED IN ROWS

BACKGROUND OF THE INVENTION

Prior overhead crane apparatus for lifting objects from ship holds or off other storage locations have required initially moving or orienting the object to pass a cable or other line through or around the object and thereafter lifting the object.

SUMMARY OF THE INVENTION

Broadly, the present invention comprises an apparatus for gripping and lifting simultaneously a plurality of objects including rolls of material which objects are positioned in a row with each such object having one or more generally vertical surfaces. The apparatus includes a horizontal main beam having adjustable finger means located at each end for engaging and gripping vertical surfaces of each end object and a plurality of crosspieces at right angles to the main beam, each crosspiece carrying similar adjustable finger means for engaging other vertical surfaces of both end and intermediate objects.

It is a feature that the end and side finger holders are positioned and shaped to fit between the rows of objects being lifted and a row adjacent. Partial rows can also be lifted using the apparatus of the invention.

It is a feature that the finger holders and means are elongated for gripping two or more of such objects, or two or more rows of objects vertically stacked.

DESCRIPTION OF THE PREFERRED EMBODIMENT

Figure 1:
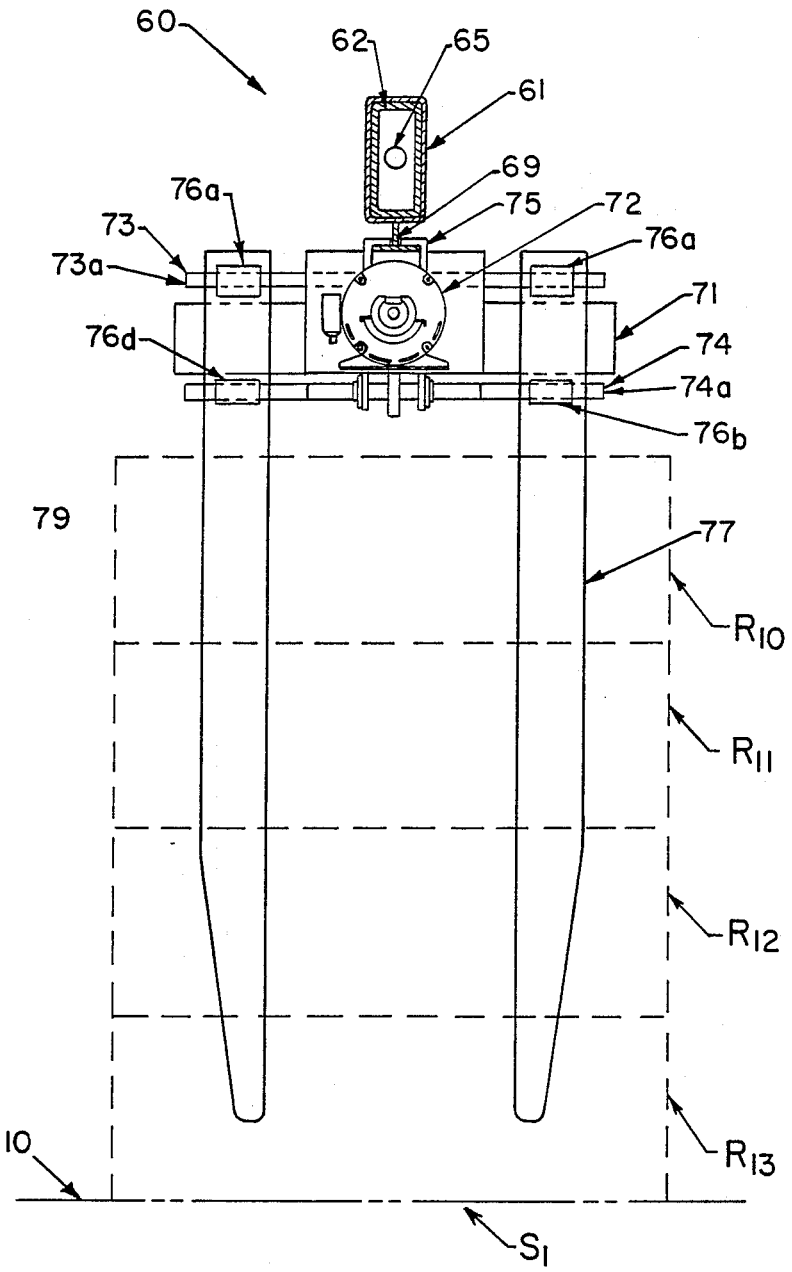
FIG. 1 is a vertical sectional view taken along line 1—1 of FIG. 2.
Figure 2:
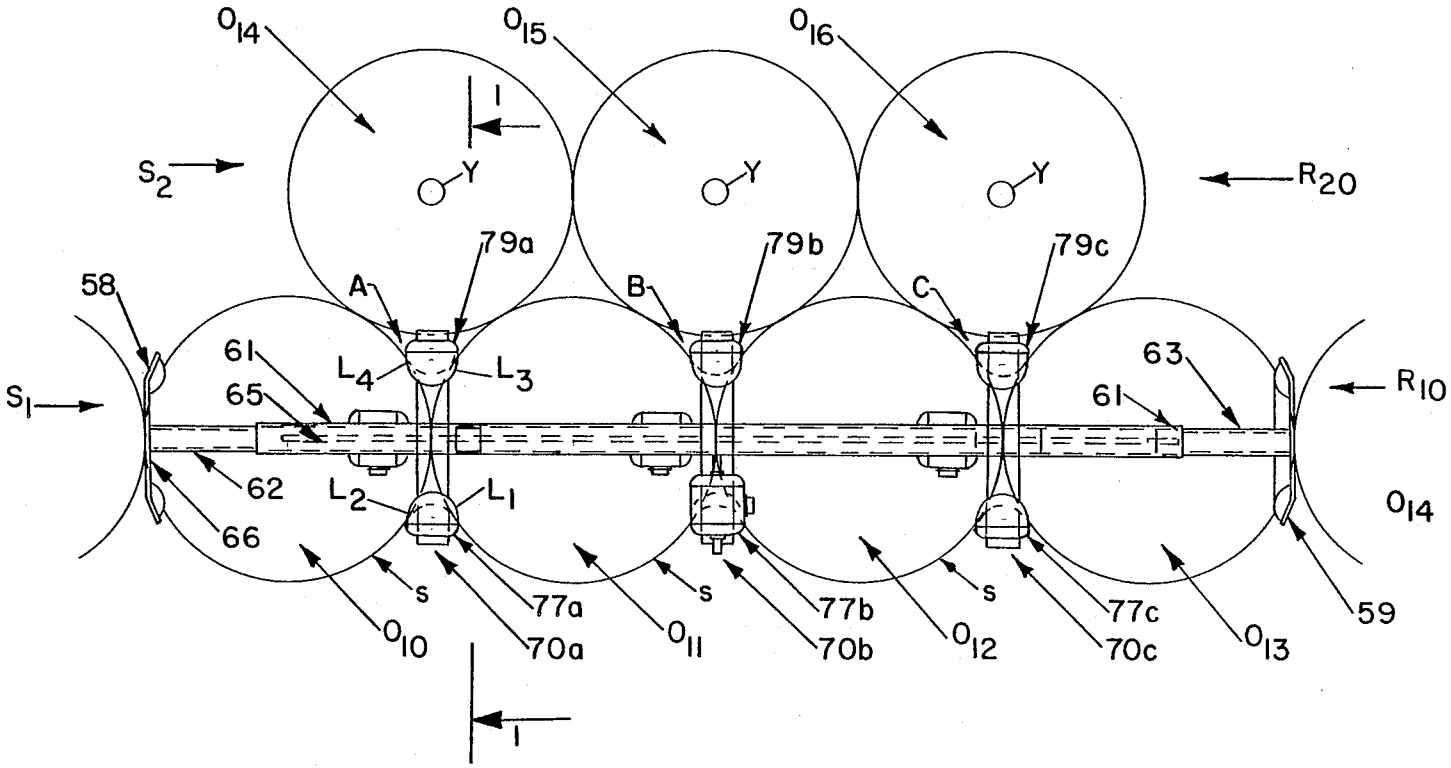
FIG. 2 is a plan view of the apparatus positioned over a first row with a second row adjacent.

In FIGS. 1 and 2, objects, such as rolls of paper or pulp material, are positioned on a floor, ship deck or other surface 10 in adjacent horizontal stacks $S_1$, $S_2$. Stack $S_1$ is composed of stacked rows $R_{10}$, $R_{11}$, $R_{12}$, $R_{13}$ superimposed. Row $R_{10'}$ in turn is composed of cylindrical objects $O_{10}$, $O_{11}$, $O_{12}$, $O_{13}$, and $O_{14}$ and row $R_{20}$ includes objects $O_{14}$, $O_{15}$, and $O_{16}$. The spaces A, B and C between rows $R_{10}$ amd $R_{20}$ provide access for the fingers 77*a–c*, 79*a–c*. Objects $O_{14}$–$O_{16}$ have vertical axes Y.

The lifting apparatus 60 includes a main outer horizontal beam 61 including end inner beams 62, 63 telescopically positioned in main beam 61 and adjustable using a threaded rod 65 rotated by a power mechanism in a threaded block (not shown) rigidly attached to the telescoping end inner beams 62, 63 to vary the distance each end beam 62, 63 extends from main beam 61. Each inner end beam 62, 63 is part of gripper unit 58, 59 (see FIG. 5). Inner beam 61 has depending from its end two vertical fingers 67, 68 mounted on V-shaped frame 66 with brace 66*a*. Fingers 67, 68 are urged in a direction parallel to the main beam 61 by rotation of thread rod 65 through a fixed threaded piece (not shown) until fingers 67, 68 engage vertical surfaces S of rolls $O_{10}$, $O_{20}$, $O_{30}$, and $O_{40}$ to provide satisfactory gripping based on frictional forces. Fingers 67, 68 do not move toward each other as they are carried by frame 66. Gripper unit 59 is similarly constructed. The cylindrical object $O_{10}$, $O_{20}$, $O_{30}$, and $O_{40}$ have one continuous vertical surface S area while other shaped objects contemplated to be gripped and lifted by the apparatus of the present invention may, if triangular in cross-section, have three (3) sides or if cubic or polygonal may have four (4) or more sides.

Figure 5:
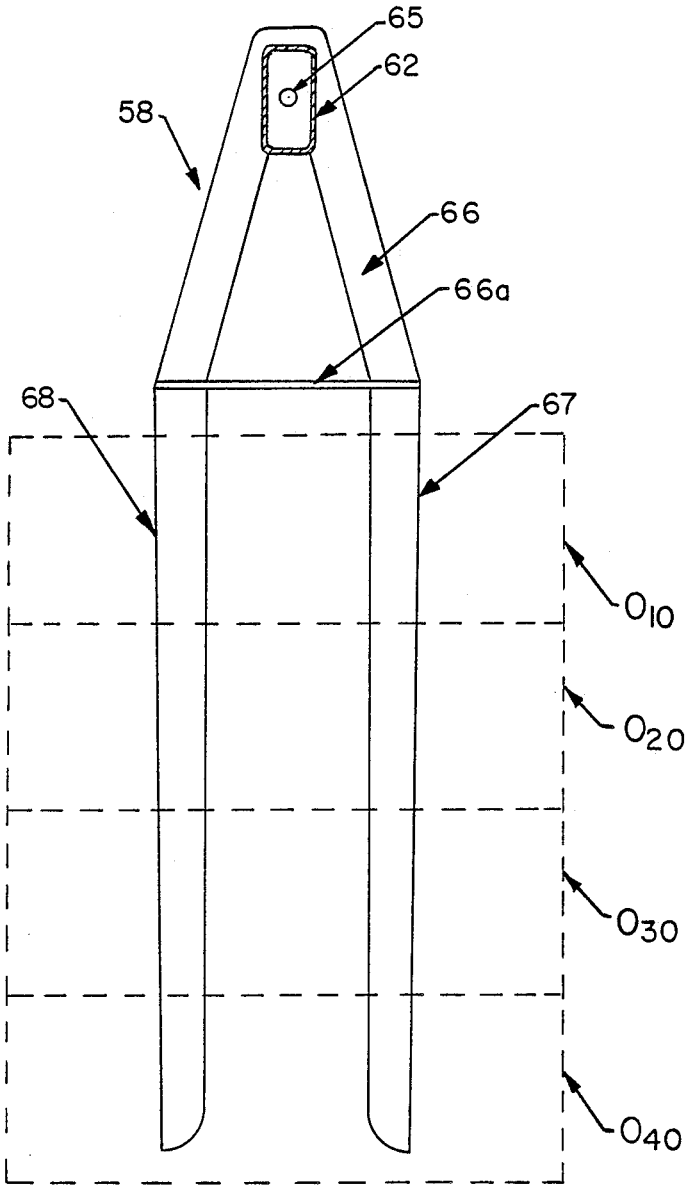
FIG. 5 is an end elevational view showing the end finger means for gripping the end lifted object in a row.

In addition to end gripper units 58, 59 transverse gripper units 70*a–c* are located spaced-apart along a T-track 69 below the main beam 61 (FIGS. 1 and 2), and are relocateable as properly lubricated track follower 75 rides on T-track 69. Transverse gripper units 70*a–c* are each self-adjusting in that each unit will slide on T-track 69 as fingers 77,79 (or fingers on other units) move toward each other and engage adjacent objects. Such self-adjustment accommodations for objects which vary slightly in size and shape. Transverse gripper unit 70*a* also includes frame piece 71, motor 72, superimposed axles 73, 74 mounted on frame piece 71 and rotated by motor 72 at reduced speeds in either direction of rotation. Axles 73, 74 carry threads 73*a*, 74*a* which mate with threaded sleeves 76*a–b* on vertical side gripper finger 77 and sleeves 76*c–d* on vertical gripper finger 79. Through rotation of threaded axles 73, 74 in interaction with finger sleeves 76*a–d*, vertical fingers 77 and 79 can be moved toward and away from one another to grip cylindrical objects $O_{10}$ and $O_{11}$ along lines $L_{1\text{-}4}$ (FIG. 2). Roll $O_{10}$ is thus gripped along four (4) lines $L_{1\text{-}4}$ (FIGS. 2 and 5). Gripper units 70*b* and *c* are similarly constructed.

Figure 3:
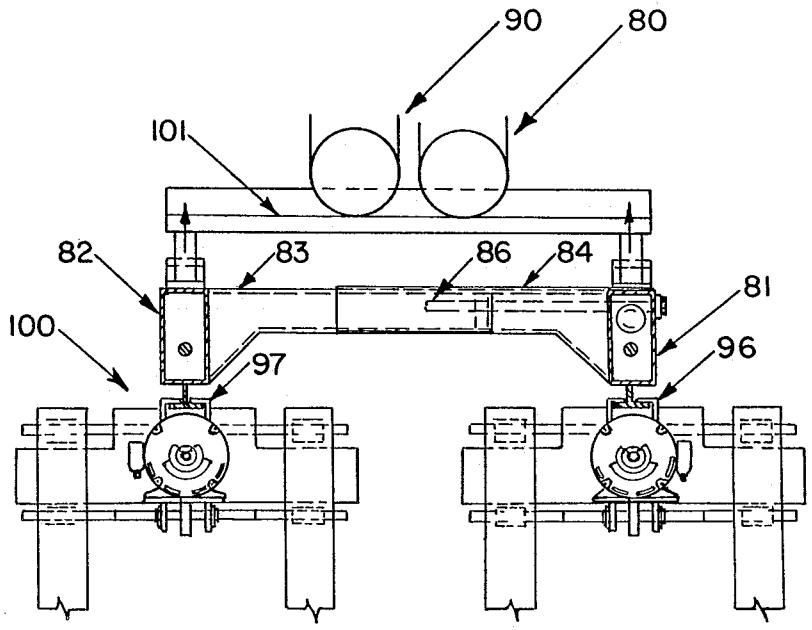
FIG. 3 shows a twin apparatus for serving two adjacent rows at one time.
Figure 4:
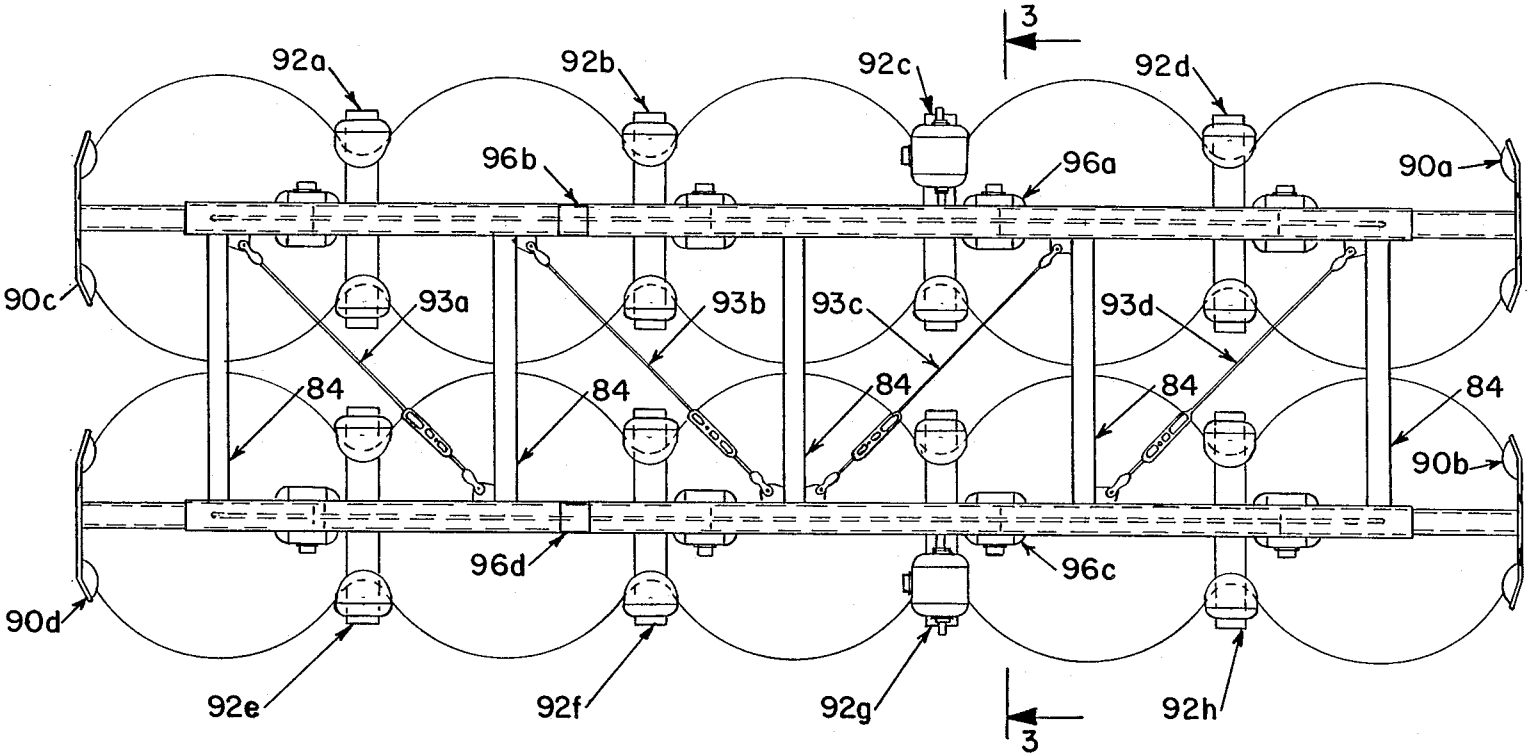
FIG. 4 shows a twin apparatus with means for tying the two units together.

Turning now to FIGS. 3 and 4, twin apparatus 80 is shown in which parallel spaced-apart main beams 81, 82 are interconnected by cross-links 83, 84 telescopically engaged. Drive screw 86 provides for adjustment of the spacing of main beams 81, 82. Carriage 101 permits lifting and lowering the twin apparatus 80 by a suitable crane 90. Twin apparatus 80 has four (4) end lifters 90*a–d* and eight (8) cross finger lifters 92*a–h*. Brace cables 93*a–d* increase the rigidity of the twin apparatus 80. Turning to FIG. 3 each main beam 81, 82 have track followers 96, 97 respectively on left apparatus 100 and right lifting apparatus 101, each of which is constructed similarly to apparatus 60 shown in FIGS. 1 and 2. Also shown in FIG. 4 are lifting attachments 96*a–d* for connecting carriage 101 to main beams 81, 82.

I claim:

1. An apparatus for gripping and lifting a plurality of similarly-shaped vertically stacked objects having vertical side areas with selected vertical height positioned in a first row adjacent to a second row of similarly-stacked objects, the stacked objects in the first and second rows being shaped and spaced-apart to provide spaces between said rows and adjacent stacked objects, the improvement comprising a. main elongated beam having two ends movable to a position over a group consisting of a row of stacked objects to be lifted;

b. means for moving the main beam to such position and to a plurality of other positions;

c. first-end-located end gripping finger means at one end of the beam and second-end-located end gripping finger means at the other end of the beam, said first and second end gripping end fingers means being horizontally adjustable parallel to said beam;

d. cross gripping units horizontally adjustable along and parallel to said beam including horizontally adjustable side finger means positioned between the end-located gripping finger means at various locations along the main beam, said finger means adjustable perpendicularly to said beam and shaped to fit in said spaces between said first and second rows; and e. such first-end-located finger means, such second-end-located finger means and such cross gripping units including vertically oriented movable fingers movable to engage said objects and which fingers remain in such vertical orientation during their movement to engage the objects along the vertical periphery of said objects extending over a distance substantially equal to the object's vertical height whereby each object in the group to be lifted is gripped by either said end and side gripping finger means or said side gripping finger means when said apparatus is adjusted to engage each object's vertical side areas.

2. An apparatus for lifting and gripping two adjacent parallel rows of similarly-shaped vertically stacked objects having spaces between said rows and between said stacked objects comprising a. Two main elongated beams spaced apart so that each is positional above one of such rows, each beam having two ends and each beam being connected to the other for movement as a unit;

b. means for moving the main beams as a unit to a plurality of positions including above the rows and positions remote therefrom;

c. first-end-located end gripping finger means at one end of each beam and second end-located end gripping finger means at the other end of each main beam, said first and second end gripping finger means being horizontally adjustable parallel to each said beam;

d. cross gripping units horizontally adjustable along and parallel to said beam including horizontally adjustable finger means positioned between the end-located gripping finger means at various locations along the main beam, said end and cross finger means adjustable perpendicular to said beam and shaped to fit in said spaces between said first and second rows and said stacked objects; and e. such first-end-located finger means, such second-end-located finger means and such cross gripping units including vertically oriented movable fingers movable to engaged said objects which fingers remain in such vertical orientation during their movement to engage the objects along the vertical periphery of said objects extending over a distance substantially equal to the object's vertical height whereby each object to be lifted is gripped by either said end and side gripping finger means or by said side gripping finger means when said apparatus is adjusted to engage each object.

3. The apparatus of claim 1 in which the objects are cylindrically shaped and are positioned in rows with their axes in vertical planes.

* * * * *

UNITED STATES PATENT AND TRADEMARK OFFICE

CERTIFICATE OF CORRECTION

PATENT NO. : 4,968,212

DATED : November 6, 1990

INVENTOR(S) : JOHN O. McNAMARA

It is certified that error appears in the above-identified patent and that said Letters Patent is hereby corrected as shown below:

Column 2, line 6, "object" should read --objects--.

Column 3, line 1, "gripping end fingers" should read --gripping finger--.

Column 4, line 21, "engaged" should read --engage--.

Signed and Sealed this

Twenty-first Day of April, 1992

*Attest:*

HARRY F. MANBECK, JR.

*Attesting Officer*

*Commissioner of Patents and Trademarks*